US012606220B2

(12) United States Patent
Henrici

(10) Patent No.: US 12,606,220 B2
(45) Date of Patent: Apr. 21, 2026

(54) SAFETY DEVICE

(71) Applicant: Christian M. Henrici, Warsaw, NY (US)

(72) Inventor: Christian M. Henrici, Warsaw, NY (US)

( * ) Notice: Subject to any disclaimer, the term of this patent is extended or adjusted under 35 U.S.C. 154(b) by 638 days.

(21) Appl. No.: 18/121,681

(22) Filed: Mar. 15, 2023

(65) Prior Publication Data

US 2024/0308554 A1 Sep. 19, 2024

(51) Int. Cl.
*B61K 13/00* (2006.01)
*B61L 15/00* (2006.01)
*B61L 23/10* (2006.01)

(52) U.S. Cl.
CPC ..... *B61K 13/00* (2013.01); *B61L 15/0054* (2013.01); *B61L 23/10* (2013.01)

(58) Field of Classification Search
CPC ..... B60T 17/043; B61G 3/04; B61K 13/00; B61L 15/0054; B61L 15/009; B61L 23/10
See application file for complete search history.

(56) References Cited

U.S. PATENT DOCUMENTS 2,959,429 A * 11/1960 Lavelle ..... B62D 53/0878 280/421
4,492,386 A * 1/1985 Roberts ..... F16B 45/023 24/600.1
4,747,302 A * 5/1988 Goss ..... B60Q 1/30 248/231.21
5,027,477 A * 7/1991 Seron ..... F16P 1/00 24/3.13
6,227,625 B1 * 5/2001 Gaughan ..... B61L 15/0027 73/39
8,696,071 B2 * 4/2014 Root ..... B60T 13/662 303/47
9,540,059 B2 * 1/2017 Shirk, Jr. ..... B62D 53/0857
10,183,537 B2 * 1/2019 Jennex ..... B60D 1/583
11,025,076 B2 * 6/2021 Thiel ..... H05K 5/0086
11,052,270 B2 * 7/2021 Voss ..... E06C 7/187
2013/0207447 A1 * 8/2013 De Lima ..... F16B 39/101 301/9.1
2024/0308554 A1 * 9/2024 Henrici ..... B61G 3/04

FOREIGN PATENT DOCUMENTS

AU 2013100037 A4 * 2/2013
CA 2879907 A1 * 8/2013 ..... B62D 53/08
DE 4124974 C2 * 2/2001 ..... B60D 1/02
ES 2928767 T3 * 11/2022 ..... B66B 5/18
FR 2614590 A1 * 11/1988 ..... B60T 7/20
NL 2017038 B1 * 1/2018 ..... B61L 15/0027

* cited by examiner

*Primary Examiner* — Jason C Smith
(74) *Attorney, Agent, or Firm* — Jona Patent Firm; Cheng Ning Jong; Tracy P. Jong

(57) ABSTRACT

A safety device including a pneumatic conductor and a pneumatic valve, the pneumatic conductor configured to be connected at a first end of the pneumatic conductor to the pneumatic valve and the pneumatic conductor configured to be connected at a second end to a second valve, wherein the second valve is configured to be pneumatically connected to an air brake system, wherein the pneumatic valve is opened to activate the air brake system and closed to de-activate the air brake system.

17 Claims, 7 Drawing Sheets

SAFETY DEVICE

BACKGROUND OF THE INVENTION

1. The Field of the Invention

The present invention relates to a rail safety device for rail workers. More specifically, the present invention is directed to an end-of-train rail safety device useful for externally immobilizing a train as well as providing visual and audible warnings to indicate a train is being worked and should not be operated and that precautions should be taken as there are workmen nearby.

2. Background Art

While a train is being worked or while a train is being loaded with more railcars, various pre-cautions are taken to ensure the safety of those around the train. Among other safety devices useful for alerting those working around trains are devices configured for use at the end of a train and mounted on the last railcar of a train for visual indications. Although mounted on the last railcar of the train, the safety device is disposed on the leading end of the train as a locomotive is disposed in a manner to push the railcars instead of a normal operating mode where the locomotive would be pulling the railcars. Therefore, what would normally be referred to as the end-of-train is now the leading end of a train. When trains or railcars are required to be shoved to a location, i.e., when the locomotive providing propulsion is not on the leading end of the train cars, a crewmember must be stationed on the leading end of the train. The crewmember will protect the shoving movement and give direction to the engineer of the locomotive via radio or hand signals. Since there is no locomotive on the leading end of a shoving movement, the crewmember is not afforded any protection of visible or audible signals that would normally be provided by the locomotive. The crewmember would only have a radio to communicate with the engineer, and perhaps a hand lantern at night.

A locomotive, aside from providing the motors to propel the train, also has headlights, auxiliary lights, a bell and a horn to provide warning to others. The locomotive also contains the braking equipment needed to control the train. A train or railcar moving without the locomotive on the leading end, lacks all of these safety items. The headlight typically illuminates the track ahead at night, but also calls attention to the moving train both day and night. The strobe typically calls attention to the moving train both day and night. The alarm and horn can be used to provide audible warning signals day and night. The emergency brake feature allows the crewmember to stop the movement if radio communication fails or if posed with any other imminent hazard that would require an immediate stop. There is no device available to allow a crewmember to remotely activate audible and visible safety devices to protect shoving movements nor to stop a moving train when communication with the locomotive is lost or other imminent hazard exists.

There exists a need for a safety device that is not only capable of displaying only a solid warning light but also other types of visual warnings as well as audio warnings to further assist in workmen safety around trains. There also exists a need for a safety device capable of retarding a moving train without deferring that ability to a railroad engineer. There also exists a need for remotely controllable audio and visual warnings and a remotely controllable mechanism for stopping a train.

SUMMARY OF THE INVENTION

In accordance with the present invention, there is provided a safety device including a pneumatic conductor and a pneumatic valve, the pneumatic conductor configured to be connected at a first end of the pneumatic conductor to the pneumatic valve and the pneumatic conductor configured to be connected at a second end to a second valve, wherein the second valve is configured to be pneumatically connected to an air brake system, wherein the pneumatic valve is opened to activate the air brake system and closed to de-activate the air brake system.

In one embodiment, the safety device further includes an enclosure within which the pneumatic valve is disposed, wherein the enclosure is a briefcase-style enclosure to allow easy access to the pneumatic valve for maintenance. In one embodiment, the safety device further includes a mounting rod configured to be insertable into an aperture of at least about 1.25 inch in diameter. In one embodiment, the safety device further includes a visual output device. In one embodiment, the safety device further includes a lamp configured for supplying light at a brightness of at least about 5900 lumens. In one embodiment, the safety device further includes a strobe light configured for supplying light of an intensity of about 100-1000 candela. In one embodiment, the visual output device is configured to be remotely controllable by a controller. In one embodiment, the safety device further includes an audio output device. In one embodiment, the safety device further includes a bell configured for supplying sound of at least about 97 decibels. In one embodiment, the safety device further includes a horn configured for supplying sound of at least about 113 decibels. In one embodiment, the audio output device is configured to be remotely controllable by a controller. In one embodiment, the safety device further includes a controller, the pneumatic valve is configured to be remotely controllable by the controller. In one embodiment, the safety device further includes a handheld remote controller configured to control the pneumatic valve to open or to control the pneumatic valve to close. In one embodiment, the handheld remote controller includes a magnet configured to hold the handheld remote controller to a magnetic material. In one embodiment, the safety device further includes a lanyard configured to be attached to the handheld remote controller to facilitate transport of the handheld remote controller by the lanyard. In one embodiment, the lanyard is configured to be separable to prevent strangling of a user by the lanyard when it is used around the neck of the user. In one embodiment, the safety device further includes a pressure gauge configured to be functionally connected to the pneumatic conductor to sense the pressure of the air brake system. In one embodiment, the safety device further includes a rechargeable battery configured to power the pneumatic valve. In one embodiment, the safety device further includes a reflector.

In accordance with the present invention, there is further provided a safety device including:

(a) a lamp configured for supplying light at a brightness of at least about 5900 lumens;
(b) a controller; and
(c) an enclosure within which the controller is disposed, wherein the enclosure is a briefcase-style enclosure to allow easy access to at least one of the lamp and controller for maintenance.

An object of the present invention is to provide a safety device for locally activating an air brake system of a train.

Another object of the present invention is to provide a safety device for locally activating an air brake system of a train using a remote controller.

Another object of the present invention is to provide a safety device capable of supplying visual and audible warnings.

Another object of the present invention is to provide a safety device that can be easily actuated by a user riding on a railcar.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—safety device
4—port
6—mounting rod
8—lamp, e.g., headlight
10—strobe or strobe light
12—pneumatic conductor
14—valve
16—pneumatic valve, e.g., magnet valve
18—pressure gauge
20—bell
22—horn
24—locomotive
26—master on/off switch
28—pushbutton to toggle through strobe light colors
30—charging port
32—trainline air connection
34—remote controller
36—stop button
38—stop reset button
40—alarm/bell on/off button
42—horn on/off button
44—headlight on/off button
46—strobe on/off button
47—button enabling toggling of strobe light
48—lanyard
50—communication module
52—controller
54—battery
56—plug
58—socket
60—magnet
62—control button
64—user or rail worker
66—handhold
68—side wall of railcar
70—vent pipe
72—enclosure
74—cover
76—hinge
78—reflector
80—handle
82—aperture
84—railcar
86—knuckle

Particular Advantages of the Invention

The present safety device allows the brakes of a railcar to be applied or released. The present safety device allows the brakes of a railcar to be applied or released by remote control. As the remote controller useful for remotely controlling the application and release of the brakes of the railcar to which the present safety device is installed, e.g., typically end-of-train, and any railcars and a locomotive pneumatically connected to the present safety device, the brakes of the train can be externally controlled.

The present safety device includes a briefcase-style enclosure to allow easy access to any devices disposed therein including a valve, a controller, a lamp and a strobe light, etc., for repair and maintenance while providing protection during normal operation and transportation of the safety device.

The use of a present safety device improves railroad safety in many situations. The headlight alone provides a great improvement over the currently used handheld lanterns. The crewmember will not need to use a hand to aim the lantern and can keep that hand as a grip on the handholds or ladder.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
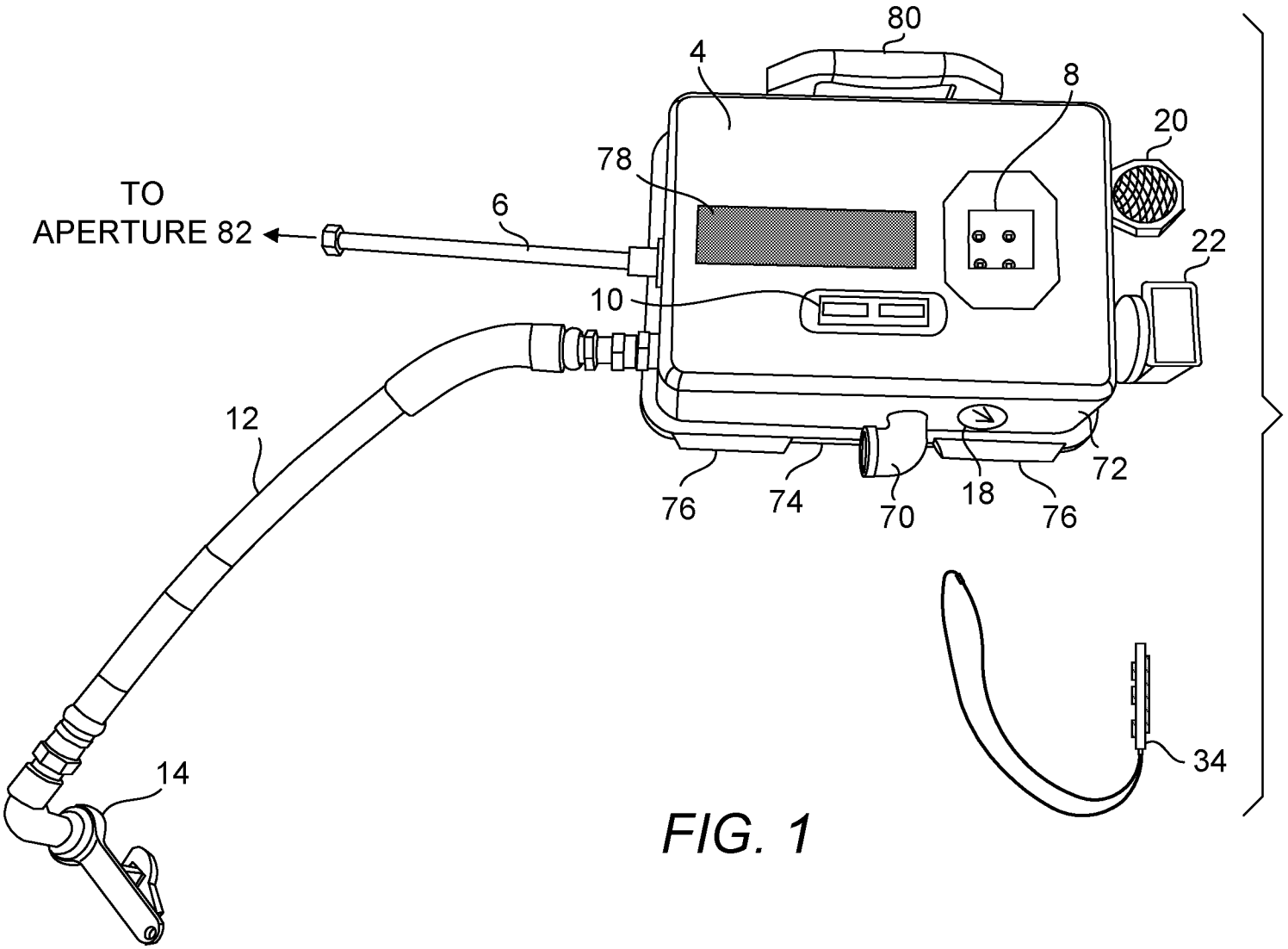
FIG. 1 is a front perspective view of one embodiment of a present safety device.
Figure 2:
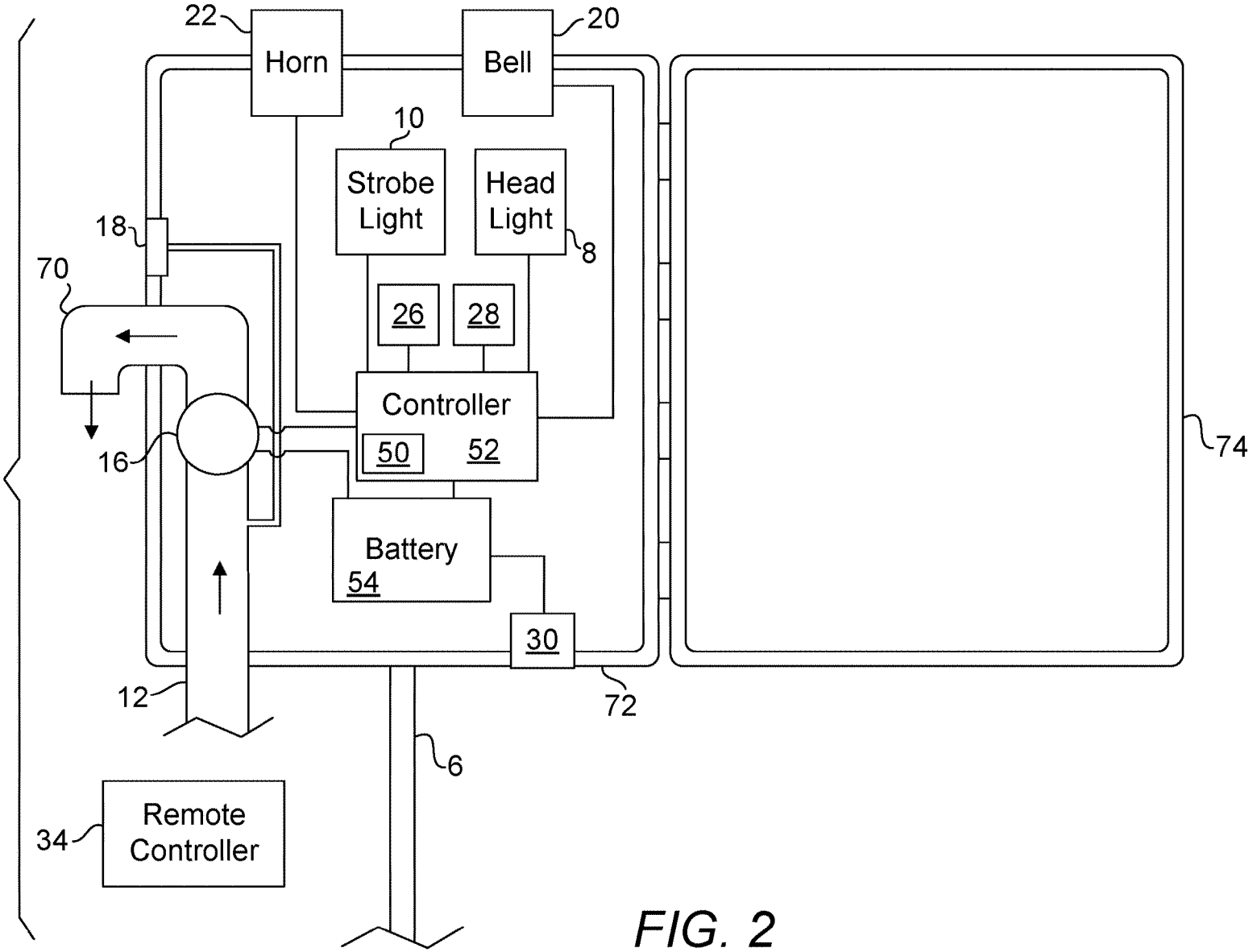
FIG. 2 is a diagram depicting the interconnections of the various devices inside one embodiment of a present safety device.
Figure 3:
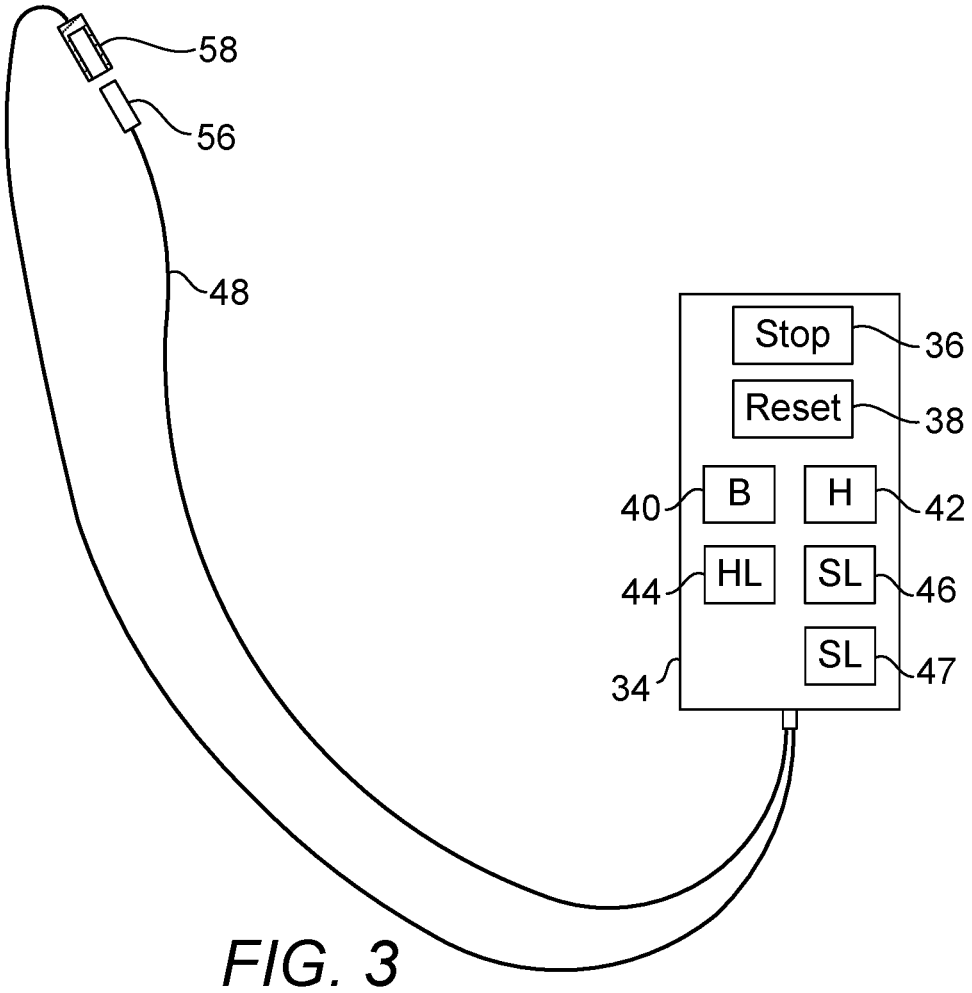
FIG. 3 is a front view of a remote controller of a present safety device and a lanyard attached thereto.
Figure 4:
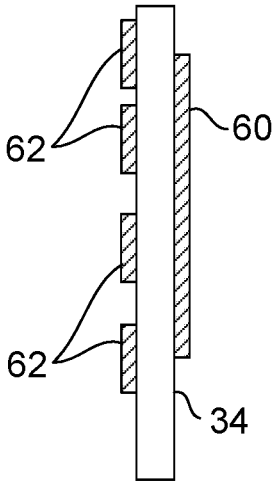
FIG. 4 is a side view of a remote controller of a present safety device.

FIG. 1 is a front perspective view of one embodiment of a present safety device 2. FIG. 2 is a diagram depicting the interconnections of the various devices inside one embodiment of a present safety device 2. FIG. 3 is a front view of a remote controller of a present safety device and a lanyard attached thereto. FIG. 4 is a side view of a remote controller 34 of a present safety device 2. The safety device 2 includes a pneumatic conductor 12 and a pneumatic valve 16, the pneumatic conductor 12 configured to be connected at a first end of the pneumatic conductor 12 to the pneumatic valve 16 and the pneumatic conductor 12 configured to be connected at a second end to a second valve 14. The second valve 14 is configured to be pneumatically connected to an air brake system, wherein the air brake system can be activated by opening the pneumatic valve 16 and de-activated by closing the pneumatic valve 16. With this ability, the user can respond to an emergency situation that requires that a train to be stopped immediately to avoid potential hazards to the train and the workmen and properties around the train. To activate the air brake system to cause the train to stop, the user simply needs to press a button on a remote controller 34 operationally connected to the pneumatic valve 16, e.g., button 36, which subsequently activates or opens the pneumatic valve 16 to vent the air brake system, causing the air brakes to be applied to stop the train.

In the embodiment shown in FIG. 1, the safety device 2 further includes an enclosure 72 within which the pneumatic valve 16 is disposed. The enclosure 72 is a briefcase-style enclosure to allow easy access to the pneumatic valve 16 and any other devices disposed therein for maintenance. The enclosure 72 includes essentially two covers 74 hingedly connected with a hinge 76 at one of the edges of each cover 74. The contents or the interior space of the enclosure 72 can be easily revealed by spreading the two covers 74 bound only at the hinge 76, greatly facilitating access for repair and maintenance of any devices disposed therein. A handle 80 is provided as a handhold for carrying the safety device 2. There is further provided a vent pipe 70 configured to extend from the pneumatic valve 16 such that when the pneumatic conductor 12 has been operationally connected via second valve 14 to a train's air brake system, the pressurized air can be vented outside of the enclosure 72. The exhaust of the vent pipe 70 is directed in a manner to vent in a direction downwardly (or pointing at the ground when the safety device is disposed in its mounted position) and substantially parallel to an outer surface of the enclosure 72 instead of being normal to the outer surface to avoid accidentally venting a pressurized air flow in the direction of a workman. By directing the exhaust of the vent pipe 70 downwardly, rain and snow precipitation can also be avoided. Referring to FIG. 2, a present safety device 2 is powered by a battery 54, e.g., a rechargeable battery, configured to receive charging current via charging port 30.

The safety device 2 further includes a mounting rod 6 configured to be insertable into an aperture of at least about 1.25 inch in diameter, e.g., an aperture 82 available in a knuckle 86 disposed at any end of a railcar. The safety device 2 further includes a visual output device, e.g., a lamp 8 configured for supplying light at a brightness of at least about 5900 lumens and a strobe light 10 configured for supplying light of an intensity of about 100-1000 candela. For convenience and safety, each visual output device 8, 10 is configured to be remotely controllable by a controller 52 with a remote controller. In one embodiment, even if a user has forgotten to turn on the safety device 2 upon mounting it to the end of a train, it can be safely and expediently turned on from afar, within the remote controller's influence, e.g., about 600 ft. This way, the user is less likely to be distracted and focus on the work at hand around the time the safety device is being turned on. The safety device 2 further includes an audio output device. In one embodiment, the safety device further includes a bell 20 configured for supplying sound of at least about 97 decibels. The safety device 2 further includes a horn 22 configured for supplying sound of at least about 113 decibels. Each of the audio output devices 20, 22 is configured to be remotely controllable by a controller 34. The safety device 2 includes a master on or off switch 26 and a pushbutton 28 configured to toggle through strobe light colors. The safety device 2 further includes a controller 52 functionally connected to other devices disposed within the safety device. The controller 52 further includes a communication module 50 configured for communication with the remote controller via, e.g., radio communication. The pneumatic valve 16 is configured to be remotely controllable by the controller 52. During normal operation, all control functions are accessible externally and the enclosure 72 of the safety device 2 need not be opened for this access.

The safety device 2 further includes a handheld remote controller 34 configured to control the pneumatic valve 16 to open or close. The safety device 2 further includes a pressure gauge 18 configured to be functionally connected to the pneumatic conductor 12 to sense the pressure of the air brake system. Referring to FIG. 1, it shall be noted that the pressure gauge 18 is disposed flush with a side surface of the enclosure 70, instead of a front surface or another surface of the enclosure 70. The positioning of the front face of the pressure gauge 18 on a side surface of the enclosure 70 allows a user to obtain pressure reading/s easily. The safety device further includes a rechargeable battery configured to power the pneumatic valve 16. A reflector 78 is provided to further serve as a visual alert, e.g., a passive visual alert, of a train being worked or mobilized in the vicinity of an observer. In one embodiment, the strobe light 10 is configured to display lights in several colors including white, amber, red and blue for alerts indicating different events. Each of solid white, amber and alternating white and amber light is useful for indicating the train is moving. A red light is useful for marking an end of a train. A blue light indicates that the train cannot be moved or coupled to another train as the train is being worked by workmen although the train may have already been tagged to indicate that it is not to be moved. To prevent user errors in applying or releasing the air brakes, a separate button, i.e., button 38, is provided to allow the user to reset the air brakes to release them, allowing the train to be set in motion again. The press of this button 38 requires a distinct and different action from the act of pressing button 36 to stop the train, therefore reducing the possibility of an erroneous button press had button 36 been configured for use as a means to activate and also de-activate the pneumatic valve 16. Further provided on the same remote controller 34 are several other control buttons 62 including a button 40 for turning on or off the bell 20, a button 42 for turning on or off the horn 22, a button 44 for turning on or off the headlight 8, a button 46 for turning on or off the strobe light 10 and a button 47 for enabling toggling of the strobe light 10 through a plurality of colors, e.g., white, amber, red and blue, etc.

Figure 5:
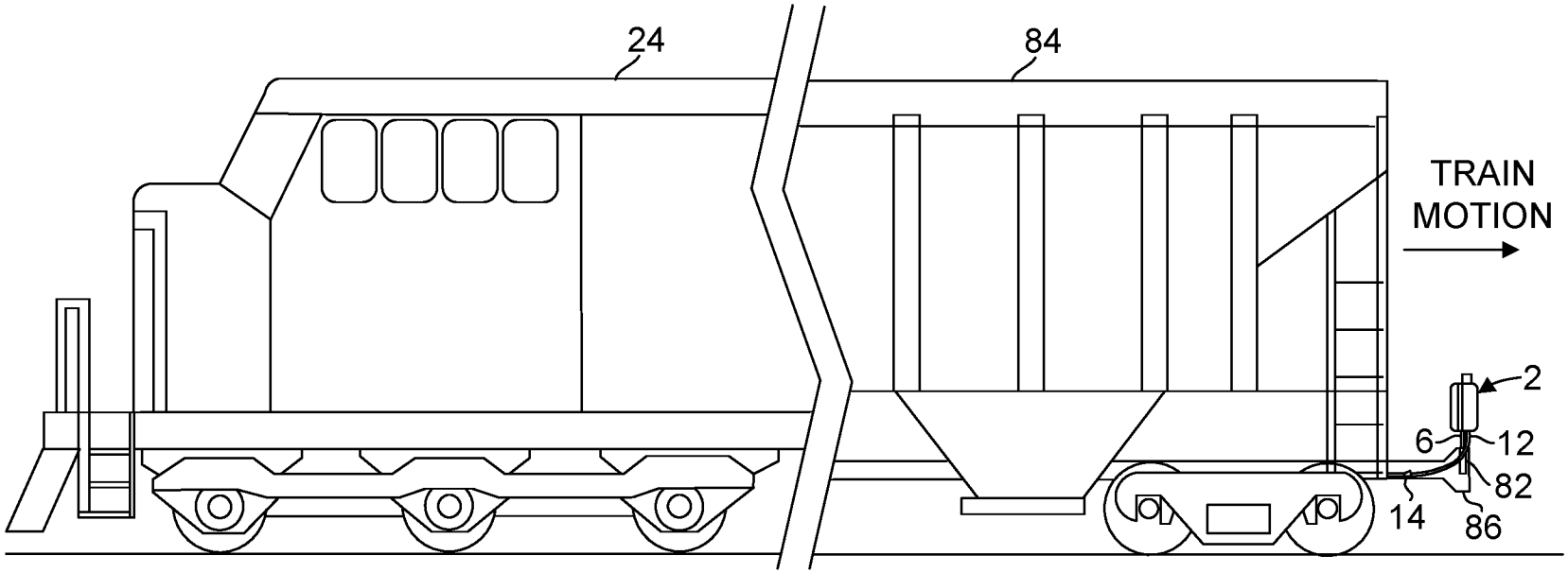
FIG. 5 is a diagram depicting a knuckle of a train in which a present safety device is disposed.
Figure 6:
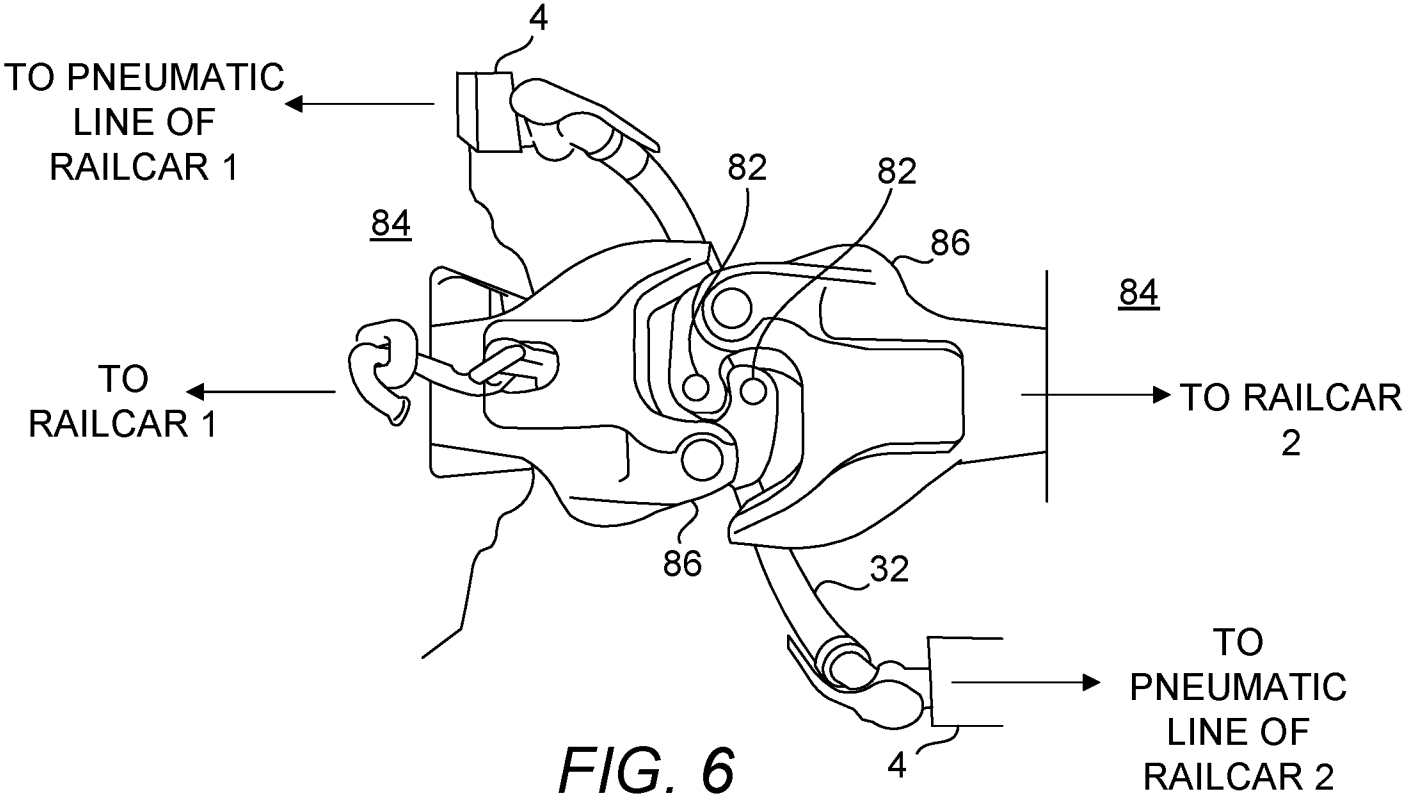
FIG. 6 is a close-up view of two railcars connected by means of knuckles, depicting a readily available aperture in which a present safety device can be mounted.

FIG. 5 is a diagram depicting a knuckle 86 of a train in which a present safety device is disposed while in use. FIG. 6 is a close-up view of two railcars connected by means of two knuckles 86, depicting a readily available aperture 82 in which a present safety device can be mounted. Also shown is a trainline air connection 32 between two railcars 84. Portions of two railcars 84 are shown for illustrative purposes only in identifying the part, i.e., knuckle 86, of a railcar in which a present safety device can be mounted. A present safety device can be mounted by its mounting rod 6 in an aperture 82 of an end-of-train knuckle 86, i.e., a knuckle not connected to another railcar. In use, the trainline air connection 32 does not exist as the air line of a railcar terminates at a port 4. A present safety device is pneumatically connected to the port 4 of a railcar upon which it is mounted via valve 14.

Figure 7:
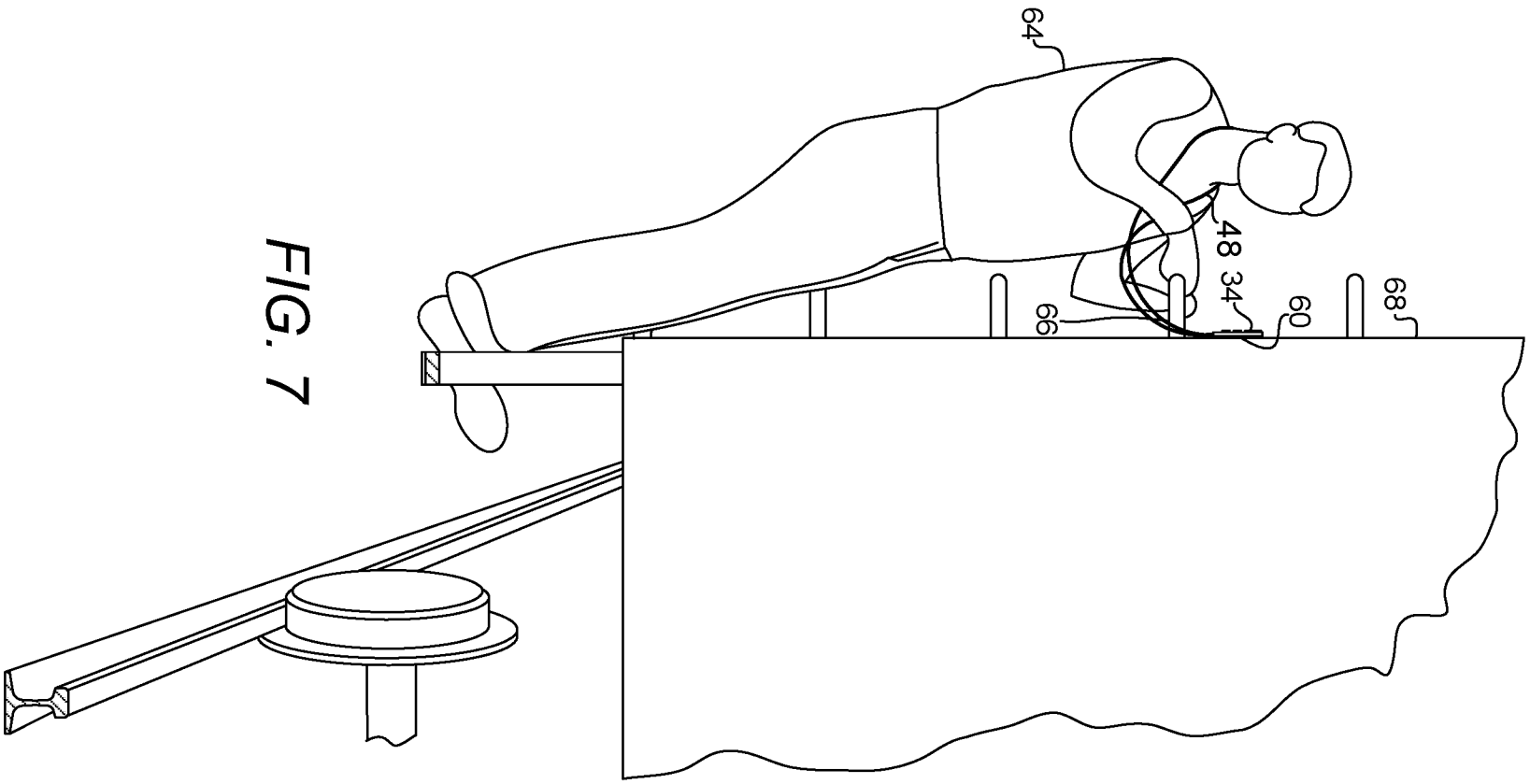
FIG. 7 is a diagram depicting a workman riding on a train securely holding onto a handhold while having the ability to interface with the remote controller if necessary.

FIG. 7 is a diagram depicting a workman 64 riding on a train securely holding onto a handhold 66 while having the ability to interface with the remote controller 34 if necessary. In the embodiment shown in FIG. 4, the handheld remote controller 34 includes a magnet 60 configured to hold the handheld remote controller 34 to a magnetic material, e.g., a side wall 68 of a railcar. In one embodiment, the safety device further includes a lanyard 48 configured to be attached to the handheld remote controller 34 to facilitate transport of the handheld remote controller 34 by the lanyard 48. It shall be noted that the lanyard 48 is configured to be separable to prevent strangling of a user 64 by the lanyard 48 when it is used around the neck of the user 64. The lanyard 48 is constructed from a strap, string, etc., and terminated in a plug 56 at one end and a socket 58 at the other end. The two parts 56, 58 are removably coupled in a coupling to form a lanyard to allow the lanyard 48 to break away at the coupling should an excessive force is applied to the lanyard, e.g., when the lanyard 48 is tucked on. A railcar is a railway vehicle that is adapted to travel on the rails of a railway and is largely used for hauling materials. Railcars are typically coupled together to form a train and are hauled by a locomotive (see part 24 of FIG. 5). In placing railcars at destinations or a rail yard such that their contents can be unloaded or new contents loaded, in order to avoid having to walk distances, rail workers typically ride onboard railcars by standing on a sill step and clinging onto one or more handholds 66 disposed above the sill step. A rail worker may stand on a sill step and hold onto a handhold of a railcar as the railcar is transported around a rail yard. As the present remote controller 34 can be attached to a side wall 68 of the railcar, the rail worker can ride on the railcar with his or her hands free to securely hold onto a handhold 66 while being able to react to an emergency situation which requires the railcar to be stopped as the remote controller 34 can be attached to the side wall 68 of the railcar at about eye level of the rail worker 64, facing the rail worker 64. As the lanyard 48 is attached to the remote controller 34 and is worn around the neck of the rail worker 64, the remote controller 34 is securely held with the rail worker 64 even while the remote controller 34 is not attached to side wall 68 of the railcar 84 or at any other time. However, it is important to ensure that if the rail worker 64 accidentally falls from the sill step that the lanyard does not pose a strangulation hazard or to cause the rail worker 64 to fall unnaturally as the attachment of the magnet 60 may be sufficiently strong to still maintain the attachment of the remote controller 34 to the side wall 68 of the railcar 84.

Figure 8:
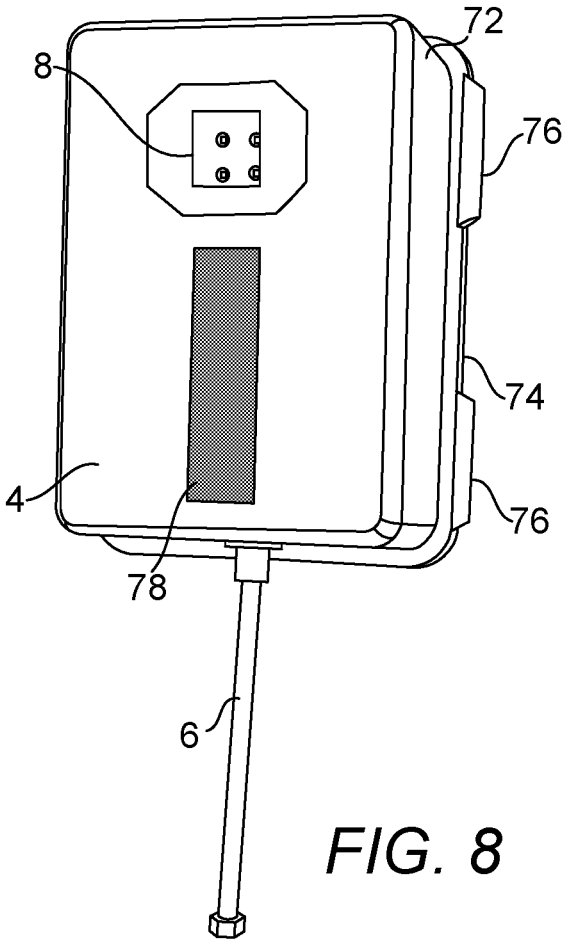
FIG. 8 is a front perspective view of one embodiment of a present safety device.

FIG. 8 is a front perspective view of one embodiment of a present safety device 2. The safety device 2 includes a lamp 8 configured for supplying light at a brightness of at least about 5900 lumens, a controller and an enclosure 72 within which the controller is disposed. The enclosure is a briefcase-style enclosure 72 to allow easy access to at least one of the lamp 8 and controller for maintenance.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A discrete safety device comprising a pneumatic conductor, a pneumatic valve comprising an inlet port and an outlet port, a second valve, an enclosure within which said pneumatic valve is disposed and a vent pipe comprising an inlet end and an outlet end, said pneumatic conductor configured to be connected at a first end of said pneumatic conductor to said inlet port of said pneumatic valve and said pneumatic conductor configured to be connected at a second end to said second valve, said inlet end of said vent pipe is configured to pneumatically connect the exhaust port of said pneumatic valve to atmosphere external of said enclosure, said outlet end of said vent pipe is configured to be directed towards the ground while said discrete safety device is in use, and said second valve is configured to be pneumatically connected to an air brake system external to said discrete safety device, wherein opening said pneumatic valve vents pneumatic pressure from said pneumatic conductor to apply brakes of the air brake system, and closing said pneumatic valve terminates venting of the pneumatic pressure.

2. The discrete safety device of claim 1, wherein said enclosure is comprises first and second housing portions hingedly coupled to one another, said first and second housing portions being movable between a closed position and an open position that exposes said pneumatic valve for maintenance.

3. The discrete safety device of claim 1, further comprising a mounting rod configured to be insertable into an aperture of at least 1.25 inch in diameter.

4. The discrete safety device of claim 1, further comprising a visual output device.

5. The discrete safety device of claim 4, further comprising a lamp configured for supplying light at a luminous flux of at least about 5900 lumens.

6. The discrete safety device of claim 4, further comprising a strobe light configured for supplying light of an intensity of about 100-1000 candela.

7. The discrete safety device of claim 4, wherein said visual output device is configured to be remotely controllable by a controller.

8. The discrete safety device of claim 1, further comprising an audio output device.

9. The discrete safety device of claim 8, wherein said audio output device is configured to be remotely controllable by a controller.

10. The discrete safety device of claim 1, further comprising a controller, said pneumatic valve configured to be remotely controllable by said controller.

11. The discrete safety device of claim 1, further comprising a handheld remote controller configured to control said pneumatic valve to open or to control said pneumatic valve to close.

12. The discrete safety device of claim 11, wherein said handheld remote controller comprises a magnet configured to hold said handheld remote controller to a magnetic material.

13. The discrete safety device of claim 12, further comprising a lanyard configured to be attached to said handheld remote controller to facilitate transport of said handheld remote controller by said lanyard.

14. The discrete safety device of claim 13, wherein said lanyard is comprises a breakaway connector configured to separate when subjected to a tensile force exceeding a predetermined threshold, thereby reducing risk of injury when worn around a user's neck.

15. The discrete safety device of claim 1, further comprising a pressure gauge configured to be functionally connected to said pneumatic conductor to sense the pressure of the air brake system.

16. The discrete safety device of claim 1, further comprising a rechargeable battery configured to power said pneumatic valve.

17. The discrete safety device of claim 1, further comprising a reflector.

* * * * *